US011069996B2

(12) United States Patent
Beese et al.

(10) Patent No.: US 11,069,996 B2
(45) Date of Patent: Jul. 20, 2021

(54) CONTACT PIN FOR PLUG CONNECTOR HAVING RETAINING ELEMENTS

(71) Applicant: TE Connectivity Germany GmbH, Bensheim (DE)

(72) Inventors: Philipp Beese, Floersheim (DE); Dirk Duenkel, Bensheim (DE); Jochen Brandt, Stoedtlen (DE); Gregor Panitz, Soergenloch (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/685,482

(22) Filed: Nov. 15, 2019

(65) Prior Publication Data

US 2020/0083628 A1 Mar. 12, 2020

Related U.S. Application Data

(63) Continuation of application No. PCT/EP2018/063251, filed on May 21, 2018.

(30) Foreign Application Priority Data

May 23, 2017 (DE) ..... 102017111293.6

(51) Int. Cl.
*H01R 13/04* (2006.01)
*H01R 13/41* (2006.01)

(52) U.S. Cl.
CPC ..... *H01R 13/04* (2013.01); *H01R 13/41* (2013.01)

(58) Field of Classification Search
CPC ..... H01R 13/052; H01R 13/41; H01R 13/04
(Continued)

(56) References Cited

U.S. PATENT DOCUMENTS 3,998,518 A * 12/1976 Mathe ..... H01R 13/743 439/346
4,057,315 A * 11/1977 Miller ..... H01R 12/58 439/869

(Continued)

FOREIGN PATENT DOCUMENTS

EP 0647986 A1 4/1995
EP 0854542 A2 7/1998

(Continued)

OTHER PUBLICATIONS

PCT Notification, The International Search Report and The Written Opinion, Intl. App. No. PCT/EP2018/063251, dated Aug. 8, 2018, 13 pages.

(Continued)

*Primary Examiner* — Abdullah A Riyami
*Assistant Examiner* — Marcus E Harcum
(74) *Attorney, Agent, or Firm* — Barley Snyder

(57) ABSTRACT

A contact pin for a plug connector includes a base body having a longitudinal axis and a surface, a first end adapted to be plugged into an opening of a pin strip of the plug connector, and at least four retaining elements molded on the base body. A first pair of retaining elements are arranged successively spaced apart along the longitudinal axis and a second pair of retaining elements are arranged oppositely at a same point along the longitudinal axis in a circumferential direction. The first pair of retaining elements are arranged in the circumferential direction at a first angle offset from one another. The first angle is smaller than 90°.

19 Claims, 3 Drawing Sheets

(58) Field of Classification Search
USPC ..... 439/733.1, 744, 746
See application file for complete search history.

(56) References Cited

U.S. PATENT DOCUMENTS

| | | | | | |
|---|---|---|---|---|---|
| 5,035,656 | A * | 7/1991 | Patel | H01R 12/58 | 439/733.1 |
| 5,064,389 | A * | 11/1991 | Klein | H01R 31/06 | 439/651 |
| 5,147,227 | A * | 9/1992 | Yurko | H01R 13/41 | 439/733.1 |
| 5,252,088 | A * | 10/1993 | Morello | H01R 4/185 | 439/271 |
| 5,460,549 | A * | 10/1995 | Muzslay | H01R 13/521 | 439/347 |
| 5,885,113 | A * | 3/1999 | Bricaud | H01R 13/41 | 439/733.1 |
| 5,897,401 | A * | 4/1999 | Fili | H01R 13/41 | 411/451.1 |
| 5,980,271 | A * | 11/1999 | MacDougall | H01R 13/41 | 439/733.1 |
| 6,042,429 | A * | 3/2000 | Bianca | H01R 13/41 | 439/733.1 |
| 6,328,576 | B1 * | 12/2001 | Takahashi | H01R 13/41 | 439/733.1 |
| 6,896,559 | B2 * | 5/2005 | Klein | H01R 13/04 | 439/733.1 |
| 6,979,235 | B2 * | 12/2005 | Lappohn | H01R 13/111 | 439/733.1 |
| 7,179,123 | B2 * | 2/2007 | Ohara | H01R 13/04 | 439/595 |
| 7,618,287 | B2 * | 11/2009 | Hass | H01R 13/521 | 439/589 |
| 7,722,413 | B2 * | 5/2010 | Tonosaki | H01R 13/41 | 439/733.1 |
| 8,210,856 | B2 * | 7/2012 | Suzuki | H01R 12/585 | 439/733.1 |
| 8,608,516 | B2 * | 12/2013 | Huang | H01R 13/432 | 439/751 |
| 9,153,898 | B2 * | 10/2015 | Dendas | H01R 13/516 | |
| 9,263,867 | B2 * | 2/2016 | Strelow | H02G 3/0658 | |
| 9,595,782 | B2 * | 3/2017 | Farole | H01R 13/41 | |
| 10,236,603 | B2 * | 3/2019 | Goto | H01R 43/16 | |
| 10,553,977 | B2 * | 2/2020 | Pemwieser | H01R 13/187 | |
| 2005/0074999 | A1 | 4/2005 | Ohara | | |
| 2010/0136852 | A1 * | 6/2010 | Mito | H01R 13/41 | 439/733.1 |
| 2010/0323561 | A1 * | 12/2010 | Melni | H01R 9/11 | 439/733.1 |
| 2011/0021089 | A1 * | 1/2011 | Yoshida | H01R 13/28 | 439/733.1 |
| 2016/0197430 | A1 * | 7/2016 | Fujita | H01R 13/44 | 439/733.1 |
| 2016/0233603 | A1 * | 8/2016 | Kawagishi | H01R 43/22 | |

FOREIGN PATENT DOCUMENTS

| | | | |
|---|---|---|---|
| EP | 0854542 | A3 | 10/1999 |
| JP | 200532512 | A | 2/2005 |
| JP | 2005340068 | A | 12/2005 |
| JP | 2000243495 | A | 9/2009 |

OTHER PUBLICATIONS

Chinese First Office Action, dated Jul. 15, 2020, App. No. 201880033652.1, 15 pages.

1st Japanese Office Action dated Nov. 4, 2020, in Appln. No. 2020-514347, and English translation thereof, 12 pp.

* cited by examiner

CONTACT PIN FOR PLUG CONNECTOR HAVING RETAINING ELEMENTS

CROSS-REFERENCE TO RELATED APPLICATIONS

This application is a continuation of PCT International Application No. PCT/EP2018/063251, filed on May 21, 2018, which claims priority under 35 U.S.C. § 119 to German Patent Application No. 102017111293.6, filed on May 23, 2017.

FIELD OF THE INVENTION

The present invention relates to a contact pin and, more particularly, to a contact pin for a plug connector.

BACKGROUND

A plug connector normally has an insulated pin housing with a circumferential flange and a chamber, wherein a plurality of contact pins which are plugged into a pin strip are arranged inside the pin housing. In order to guarantee a secure fit of the contact pins in the pin housing, the contact pins have a base body and retaining elements molded thereon that, for example, take the form of pairs of lugs which project beyond the circumference of the contact pin and which have a rising contour opposite to the mounting direction of the contact pin.

Upon insertion/assembly of the contact pin into the pin strip, the contact pin is successively expanded by the wedge shape of the retaining element, which facilitates the production of the plug connection and delimits the assembly forces. In the event of a straining of the contact pin, for example when producing a plug connection between a male plug connector and a female mating plug connector, the precipitous rear side of the retaining element is interlocked with the surrounding material of the pin strip, imparting a retention force. If the retention force is exceeded during the plug-in process, the base material of the pin housing which surrounds the retaining element is placed locally, ruptured, or broken up.

In order to increase the maximum retention force, at least two retaining elements are arranged successively in the direction of the longitudinal axis of the contact pin. The retaining element, however, which is successive in the longitudinal direction, may touch the already pre-damaged base material; the successive retaining element can only provide a reduced contribution to the retention force. The retaining elements successive in the longitudinal direction may also be arranged offset by 90° in the circumferential direction of the base body of the contact pin, but when the retention force is exceeded, both retaining elements can touch undamaged base material. This arrangement also has very high assembly forces.

A contact pin 100' for a plug connection known in the art is shown in FIG. 1. The contact pin 100' consists of a mechanically resistant and electrically conductive material. A first end 101 of the contact pin 100' is plugged into an opening of a pin strip of a pin housing of a male plug connector.

The contact pin 100' shown in FIG. 1 has a plurality of retaining elements 120 molded on a base body 110 so that a pin strip which is assembled in this way is mechanically resilient when producing a plug connection between a male plug connector and a female mating plug. As shown in FIG. 1, these retaining elements 120 are in this case arranged successively in the direction of a longitudinal axis x of the contact pin 100', which has the aforementioned disadvantages.

SUMMARY

A contact pin for a plug connector includes a base body having a longitudinal axis and a surface, a first end adapted to be plugged into an opening of a pin strip of the plug connector, and at least four retaining elements molded on the base body. A first pair of retaining elements are arranged successively spaced apart along the longitudinal axis and a second pair of retaining elements are arranged oppositely at a same point along the longitudinal axis in a circumferential direction. The first pair of retaining elements are arranged in the circumferential direction at a first angle offset from one another. The first angle is smaller than 90°.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
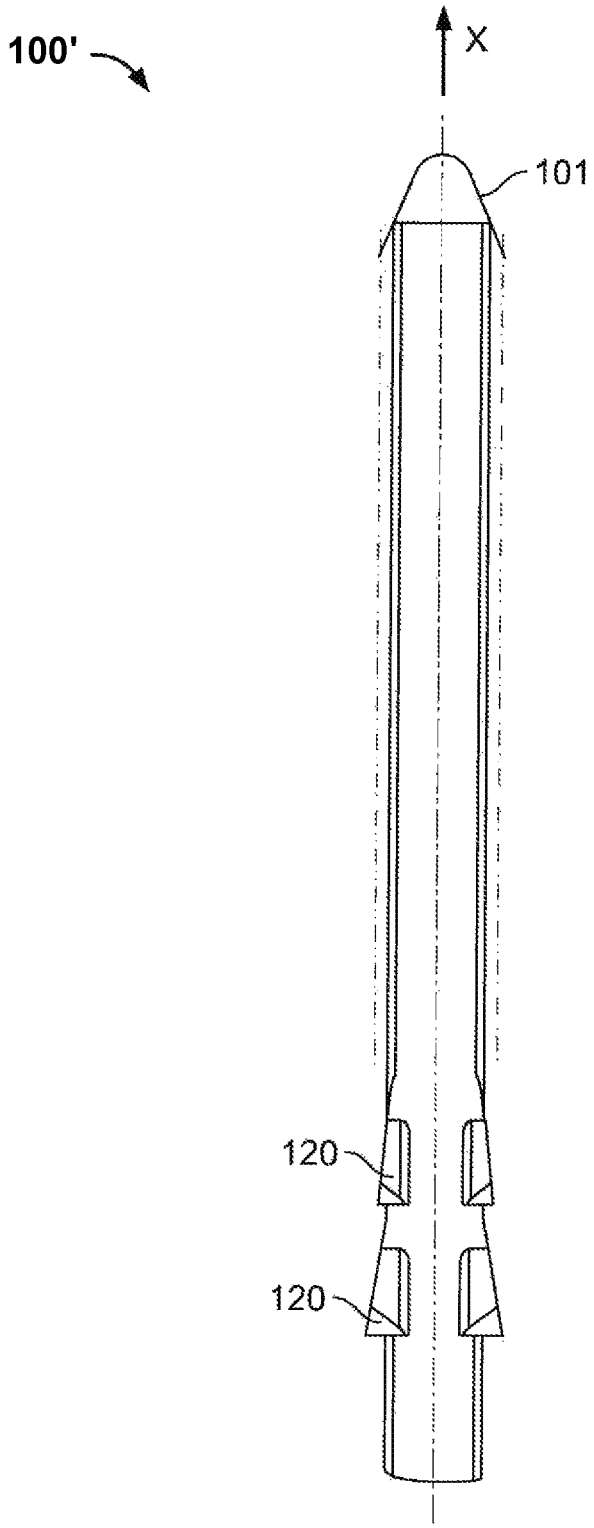
Fig. 1 (Prior art)
FIG. 1 is a top view of a contact pin known in the art.

The present invention will be described in greater detail by way of example using several embodiments with reference to the appended drawings. The embodiments merely represent possible configurations in which individual features can be realized and omitted independently of each other. In the description of the embodiments, the same technical features and technical features having the same effect are provided with the same reference numerals.

Figure 2:
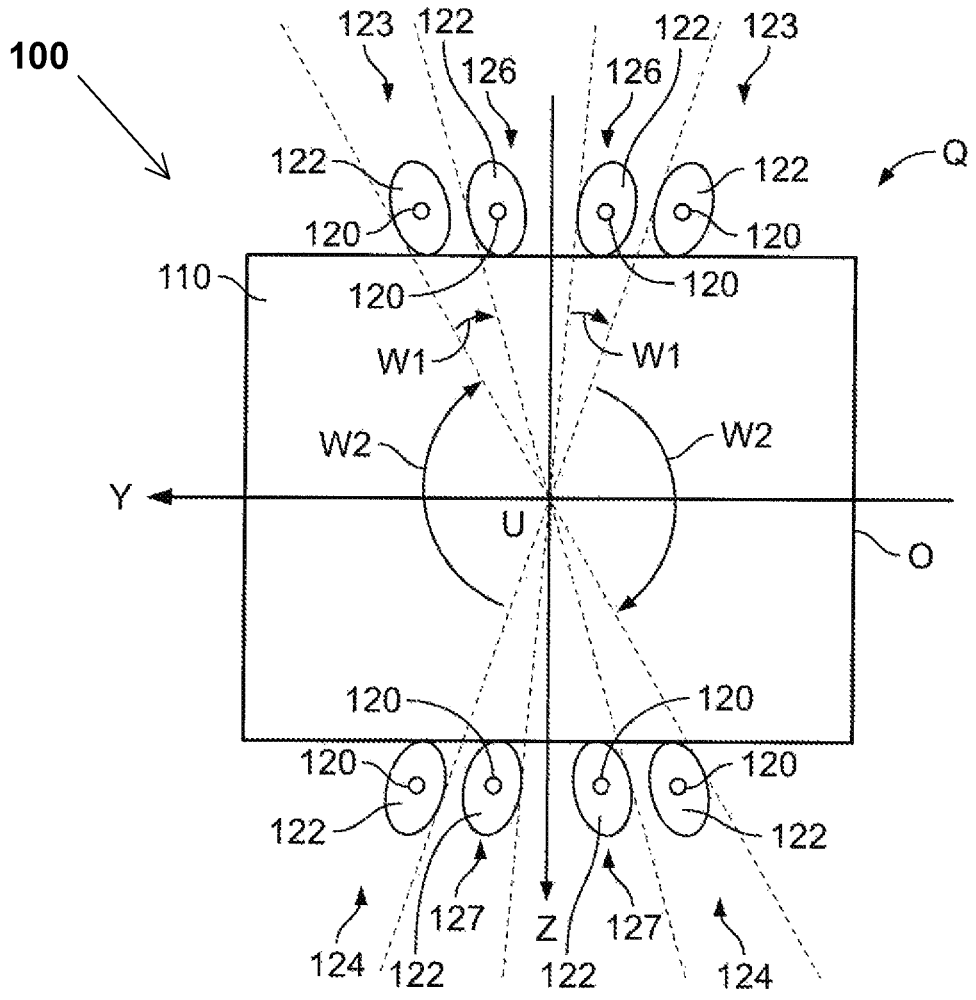
FIG. 2 is a sectional end view of a contact pin according to an embodiment of the invention.

A cross-section Q of a base body 110 of a contact pin 100 according to an embodiment of the invention is shown in FIG. 2. The contact pin 100 has a plurality of retaining elements 120. The cross-section Q, which can have the rectangular shape shown or any other shape, for example round or square, is perpendicular to the longitudinal axis x shown in FIG. 1, which defines a first axis of a spatial, Cartesian coordinate system.

The retaining elements 120 can be molded on the base body 110 in a wedge-shaped or wing-shaped manner by a forging method, stamping method, or embossing method such that they protrude further from the base body 110 at an increasing distance from an end that is plugged into a pin strip. The retaining elements 120, in an embodiment, are formed by accumulations of material which protrude from the base body 110. These accumulations of material can be provided by local deforming of the contact pin 100 or by applying additional material by welding, soldering or adhesion.

FIG. 2 shows a second axis y and a third axis z. The y-z plane which is spanned by these two axes is the plane in which the cross-section Q of the contact pin 100 can be specified at each point of the longitudinal axis x by corresponding y-z coordinates. An origin U of the coordinate system is shown in FIG. 2 as the intersection of the two coordinate axes, the longitudinal axis x consequently runs perpendicular to the plane of projection, also through the origin U. The cross-section Q is delimited by a surface O of the base body 110.

The contact pin 100 has an end which is adapted to be plugged into an opening of the pin strip of the plug connector. In an embodiment, the contact pin 100 has at least four, in the embodiment shown in FIG. 2 eight, retaining elements 120 molded on the base body 110. Two retaining elements 120 are each arranged successively spaced apart along the longitudinal axis x, and two retaining elements 120 are each arranged oppositely at the same point of the longitudinal axis x in the circumferential direction. The retaining elements 120 arranged successively are arranged offset from one another in the circumferential direction at an angle W1 in such a way that the angle W1 is smaller than 90°. The angle W1 between the successively arranged retaining elements 120 is sufficiently small that a delimitation of the assembly force which is to be applied for the assembly of the pin strip with a contact pin 100 is ensured. In various embodiments, the angle W1 is smaller than 60°, smaller than 45°, or smaller than 30°. Such an arrangement and configuration of the retaining elements 120 guarantees the prevention of the contact pin 100 from being pushed out of the pin strip in an assembled state.

In an embodiment, the contact pin 100 has at least eight retaining elements 120. Four of the retaining elements 120 are in a first group arranged relative to the longitudinal axis x on a same cross-section Q, the four retaining elements 120 in the first group have a shorter distance relative to the first end of the contact pin 100 than four retaining elements 120 in a second group.

A position of each retaining element 120 on the base body 110 is given in the coordinate system in FIG. 2 based on a centroid of a volume 122 of each retaining element 120. The shape of the retaining elements 120 in FIG. 2 are purely schematic and only show the arrangement thereof along the surface of the base body 110. The positions of all the retaining elements 120 in FIG. 2 are projected onto the y-z plane as a common plane, in order to be able to describe their arrangement in a clear manner. The arrangement of the retaining elements 120 on the surface O is described hereinafter.

Figure 3:
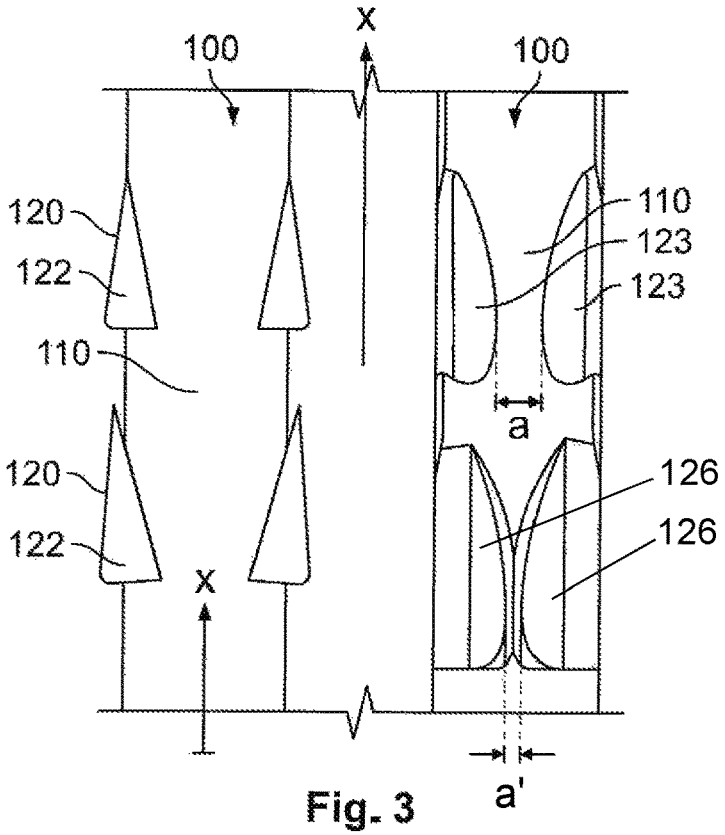
FIG. 3 is a pair of top views of the contact pin of FIG. 2 rotated 90° relative to one another.

As shown in FIGS. 2 and 3, the four retaining elements 120 each have positions which differ and are arranged on the same cross-section Q relative to the longitudinal axis x. Two retaining elements 120 form a first pair 123 and have a distance a from one another. A second pair 124 of two retaining elements 120 is arranged symmetrical with respect to the first pair 123 relative to the longitudinal axis x, and is located on the opposite side of the contact pin 100. Two retaining elements 120 form a third pair 126 and have a distance a' from one another. A fourth pair 127 is located on the opposite side of the contact pin 100, in a symmetrical arrangement relative to the longitudinal axis x.

As shown in FIG. 3, the first distance a is greater than the second distance a', the first pair 123 and the third pair 126 as well as the second pair 124 and the fourth pair 127 being arranged such that, in the event that the positions of all the retaining elements 120 are projected onto the y-z plane, as shown in FIG. 2, the projections of the third pair 126 are located centrally between the projections of the first pair 123, and the projections of the fourth pair 127 are located centrally between the projections of the second pair 124.

As shown in FIG. 2, there are no two retaining elements 120 which have positions in the y-z plane which are located on a common connecting line with the origin U, provided that the origin is not located between the positions of the retaining elements 120 on the connecting line.

Furthermore, at least two angular ranges W2 based on the origin as the vertex exist in the y-z plane, in which no retaining elements 120 are arranged, W2 respectively being greater than 120° in the depicted exemplary embodiment. By the arrangement of the angular ranges W2, in which no retaining elements 120 or their projections are located, and by the relatively large extension of these angular ranges W2 along the surface of the contact pin 100, a delimitation of the assembly force to be applied for assembling the pin strip with a contact pin 100 is ensured.

Figure 4:
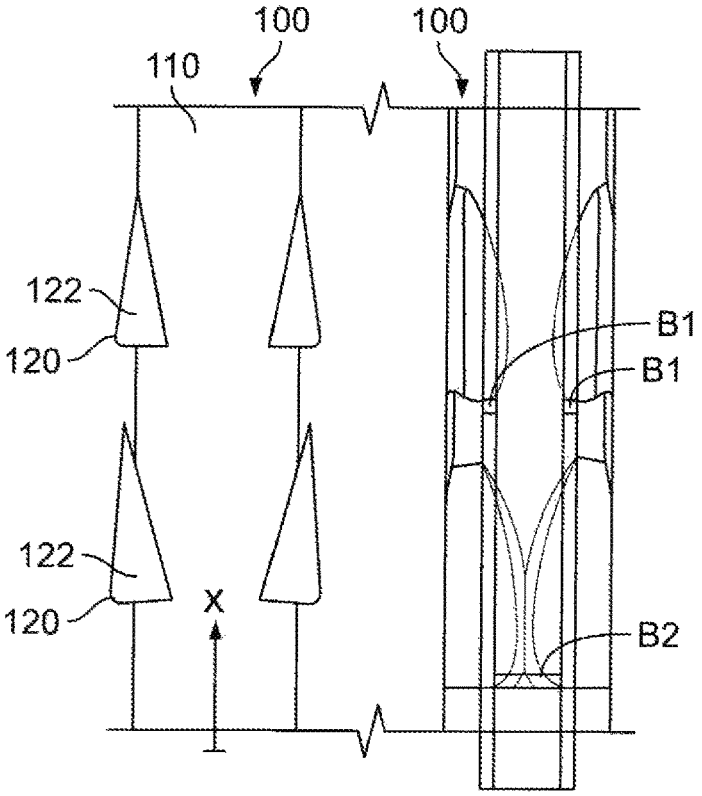
FIG. 4 is a pair of top views of the contact pin of FIG. 3 with indicated lines of action.

As shown in FIG. 4, the inventive arrangement of the retaining elements 120 on the base body 110 ensures that each retaining element 120 touches at least partially undamaged base material of the pin strip, and all retaining elements 120 provide an approximately equal contribution to the retention force. In FIG. 4, the lines of action along which retaining elements 120 that are each arranged successively provide their contribution to the total retention force, are depicted as a region B1 and a region B2. The retention force thus becomes approximately constant along a large part of the withdrawal path. In an embodiment, the retaining elements 120 are formed, with respect to their number and their dimensions, such that the retention force of the contact pin 100 from the pin housing reaches a value greater than or equal to 25 N, greater than or equal to 40 N, or greater than or equal to 60 N.

In another embodiment, a plug connector for producing a mechanical and electrical connection to a mating plug has a pin housing with a pin strip for receiving at least one contact pin 100.

What is claimed is:

1. A contact pin for a plug connector, comprising:

a base body having a longitudinal axis and a surface; and at least four retaining elements molded on the base body, a first pair of retaining elements arranged successively spaced apart along the longitudinal axis and a second pair of retaining elements arranged oppositely at a same point along the longitudinal axis in a circumferential direction, and the first pair of retaining elements are arranged in the circumferential direction at a first angle offset from one another, the first angle is smaller than 90°, wherein, with a position of each of the retaining elements projected onto a common plane of a cross-section of the contact pin, a first retaining element of the first pair of retaining elements and a first retaining element of the second pair of retaining elements are located centrally between a second retaining element of the first pair of retaining elements and a second retaining element of the second pair of retaining elements, and wherein no retaining elements are located along the surface of the contact pin in at least two circumferential angular ranges, with each angular range being greater than 90°.

2. The contact pin of claim 1, wherein the first angle is less than 60°.

3. The contact pin of claim 2, wherein the first angle is less than 45°.

4. The contact pin of claim 3, wherein the first angle is less than 30°.

5. The contact pin of claim 1, wherein the retaining elements protrude from the base body.

6. The contact pin of claim 1, wherein at least eight retaining elements are molded on the base body, a first group of four retaining elements are each arranged relative to the longitudinal axis on a same cross-section.

7. The contact pin of claim 6, wherein the first group is disposed at a shorter distance from an end of the contact pin than a second group of four retaining elements.

8. The contact pin of claim 7, wherein a first pair and a second pair of the retaining elements of the first group each have a first distance from one another.

9. The contact pin of claim 8, wherein a third pair and a fourth pair of the retaining elements of the second group each have a second distance from one another.

10. The contact pin of claim 9, wherein the first distance is greater than the second distance.

11. The contact pin of claim 10, wherein the first pair, the second pair, the third pair, and the fourth pair are arranged such that, with a position of each of the retaining elements projected onto a common plane of a cross-section of the contact pin, the third pair is located centrally between the first pair and the fourth pair is located centrally between the second pair.

12. The contact pin of claim 1, wherein at least two of the retaining elements that are not located at a same point along the longitudinal axis protrude by different amounts from the base body.

13. The contact pin of claim 12, wherein one of the retaining elements that is located further from the end protrudes further from the base body than another of the retaining elements located closer to the end.

14. The contact pin of claim 1, wherein the retaining elements are molded on the base body by a forging, stamping, or embossing method.

15. The contact pin of claim 1, wherein the retaining elements are molded on the base body in a wedge-shaped or a wing-shaped manner.

16. The contact pin of claim 15, wherein the retaining elements protrude from the base body by an increasing amount at an increasing distance from the end.

17. A plug connector, comprising:

a pin housing with a pin strip receiving a contact pin, the contact pin including:

a base body having a longitudinal axis and a surface; and at least four retaining elements molded on the base body, a first pair of retaining elements arranged successively spaced apart along the longitudinal axis and a second pair of retaining elements arranged oppositely at a same point along the longitudinal axis in a circumferential direction, and the first pair of retaining elements are arranged in the circumferential direction at a first angle offset from one another, the first angle is smaller than 90°, wherein a first retaining element of the first pair of retaining elements and a first retaining element of the second pair of retaining elements each arranged relative to the longitudinal axis on a same cross-section define a first group arranged at a first distance from one another, wherein a second retaining element of the first pair of retaining elements and a second retaining element of the second pair of retaining elements define a second group and are arranged at a second distance from one another, and wherein, with a position of each of the retaining elements of the first group and the second group projected onto a common plane of a cross-section of the contact pin, the second group is located centrally between the first group, wherein at least eight retaining elements are molded on the base body, the first group including four retaining elements each arranged relative to the longitudinal axis on a same cross-section and the second group including four retaining elements each arranged relative to the longitudinal axis on a same cross-section, wherein a first pair and a second pair of the retaining elements of the first group each have a first distance from one another, wherein a third pair and a fourth pair of the retaining elements of the second group each have a second distance from one another, and wherein the first pair, the second pair, the third pair, and the fourth pair are arranged such that, with a position of each of the retaining elements projected onto a common plane of a cross-section of the contact pin, the third pair is located centrally between the first pair and the fourth pair is located centrally between the second pair.

18. A contact pin for a plug connector, comprising:

a base body having a longitudinal axis and a surface; and at least four retaining elements molded on the base body, a first pair of retaining elements arranged successively spaced apart along the longitudinal axis and a second pair of retaining elements arranged oppositely at a same point along the longitudinal axis in a circumferential direction, and the first pair of retaining elements are arranged in the circumferential direction at a first angle offset from one another, the first angle is smaller than 90°, wherein, with a position of each of the retaining elements projected onto a common plane of a cross-section of the contact pin, no retaining elements are located along the surface of the contact pin in at least two circumferential angular ranges, with each angular range being greater than 90°.

19. The contact pin of claim 18, wherein each angular range is greater than 120°.

* * * * *